US009797398B2

(12) United States Patent
Werner et al.

(10) Patent No.: US 9,797,398 B2
(45) **Date of Patent: *Oct. 24, 2017**

(54) OPERATION CONTROL DEVICE FOR LIMITING THE AMOUNT A POSITIVE DISPLACEMENT PUMP OVER OR UNDERSHOOTS A TARGET OPERATING PARAMETER VALUE, PUMP SYSTEM AND METHOD FOR OPERATING SUCH

(71) Applicant: Allweiler GmbH, Radolfzell (DE)

(72) Inventors: Stefan Werner, Allensbach (DE); Michael Jackle, Hilzingen (DE); Christian Hopf, Muhlhausen-Ehingen (DE)

(73) Assignee: Allweiler GmbH, Radolfzell (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/178,917

(22) Filed: Jun. 10, 2016

(65) Prior Publication Data

US 2016/0281710 A1 Sep. 29, 2016

Related U.S. Application Data

(62) Division of application No. 13/520,385, filed as application No. PCT/EP2011/000618 on Feb. 10, 2011, now Pat. No. 9,404,482.

(51) Int. Cl.

| | |
|---|---|
| ***F04C 2/16*** | (2006.01) |
| ***F04B 7/02*** | (2006.01) |
| ***F04B 49/02*** | (2006.01) |
| ***F04B 49/06*** | (2006.01) |
| ***F04C 14/08*** | (2006.01) |
| ***F04C 14/06*** | (2006.01) |

(52) U.S. Cl.
CPC ..... *F04C 2/16* (2013.01); *F04B 7/02* (2013.01); *F04B 49/022* (2013.01);
(Continued)

(58) Field of Classification Search
CPC .. F04C 2/16; F04C 14/06; F04C 14/08; F04C 28/08; F04C 2240/81; F04C 2270/18;
(Continued)

(56) References Cited

U.S. PATENT DOCUMENTS 4,508,183 A * 4/1985 Drummond ..... E21B 10/18 175/215
5,927,832 A * 7/1999 Fulks ..... B60T 8/4059 303/10

(Continued)

FOREIGN PATENT DOCUMENTS

CN 1882782 A 12/2003
JP S58-098686 A 6/1983

(Continued)

*Primary Examiner* — Devon Kramer
*Assistant Examiner* — Christopher Brunjes

(57) ABSTRACT

An operational control device is disclosed for a positive-displacement pump having a motor, means for actuating the motor, state sensor means for detecting an actual operating parameter (e.g., pressure) of the pump, and operating mode means for controlling an operating mode of the pump. A first actuating mode of the operating mode means is set by the actuating means below a first operating-parameter threshold value (P1). This mode brings about a constantly rising pump pressure in the direction of an operating-parameter setpoint value (Pset) in a variable manner, which is dependent on a detected change in the operating parameter over a predefined time interval. A second actuating mode is set as normal operation to the operating-parameter setpoint value by the actuating means above the first operating-parameter threshold value. P1 is fixed or is calculated as a fraction of the operating-parameter setpoint value and/or a pump parameter correlated therewith.

9 Claims, 3 Drawing Sheets

(52) U.S. Cl.
CPC ..... *F04B 49/065* (2013.01); *F04C 14/06* (2013.01); *F04C 14/08* (2013.01); *F04C 2240/81* (2013.01); *F04C 2270/18* (2013.01)

(58) Field of Classification Search
CPC ..... F04C 2270/051; F04C 2270/185; F04B 7/02; F04B 49/06; F04B 49/08; F04B 49/20; F04B 49/065; F04B 49/022; F04B 2207/044; F04B 2207/042; F04B 2203/0209; F04B 2205/004; F04B 2205/05
USPC ..... 417/44.2, 38
See application file for complete search history.

(56) References Cited

U.S. PATENT DOCUMENTS

| | | | | |
|---|---|---|---|---|
| 6,206,643 | B1 | 3/2001 | Jeong | |
| 6,367,890 | B1 | 4/2002 | Hachtel | |
| 6,530,240 | B1 | 3/2003 | Kountz et al. | |
| 2002/0094910 | A1 | 7/2002 | Endo et al. | |
| 2003/0159800 | A1* | 8/2003 | Nierenberg | F17C 5/06 165/41 |
| 2004/0217191 | A1* | 11/2004 | Muratsubaki | F04B 49/065 239/101 |
| 2006/0216190 | A1* | 9/2006 | Beaven | F04C 2/165 418/201.1 |
| 2007/0248468 | A1* | 10/2007 | Holmberg | F04D 15/0066 417/44.2 |
| 2008/0019846 | A1* | 1/2008 | White | F04C 2/102 417/310 |
| 2010/0076658 | A1* | 3/2010 | Liao | F04D 15/0066 701/78 |

FOREIGN PATENT DOCUMENTS

| | | | |
|---|---|---|---|
| JP | H02-067478 | A | 3/1990 |
| JP | 2000-027764 | A | 1/2000 |
| JP | 2002-361124 | A | 12/2002 |

* cited by examiner

S10
Idle
S12
Go
E1
P diff > 80%
Yes
S14
Start
No
E2
80% > P diff > 5%
Yes
S16
Parameterization
S18
Start-up
No
E 3
P diff < 5%
Yes
S20
Final standard operation
No
S16
Parameterization
S18
Start-up
Alarm threshold
S22
Alarm
S24
Alarm routine

OPERATION CONTROL DEVICE FOR LIMITING THE AMOUNT A POSITIVE DISPLACEMENT PUMP OVER OR UNDERSHOOTS A TARGET OPERATING PARAMETER VALUE, PUMP SYSTEM AND METHOD FOR OPERATING SUCH

CROSS-REFERENCE TO RELATED APPLICATION

This application is a divisional of U.S. patent application Ser. No. 13/520,385, filed Apr. 5, 2013, entitled "Operation Control Device for Limiting the Amount a Positive Displacement Pump Over or Undershoots a Target Operating Parameter Value, Pump System, and Method for Operating Such," which is national stage entry of International Application Serial No. PCT/EP2011/000618, filed Feb. 20, 2011, entitled "Operation Control Device for a Positive Displacement Pump, Pump System and Method for Operating Such," which claims priority to European Patent Application Serial No. 10001449.7, filed Feb. 12, 2010, the entireties of which applications are expressly incorporated by reference herein.

BACKGROUND

The present invention relates generally to an operational control device, and more particularly to a pump system and a method for operating a pump system.

Certain machine tools must be charged with coolant and/or lubricant at operating pressures which can reach 25 bar and more. As such, pumps used to effect such charging can be particularly important. In connection with industrial drilling, milling or tapping processes, and with fluid charging at the pressures mentioned, high cooling performance and correspondingly high process speeds are desirable.

For high pressure coolant supply, positive displacement pumps have been used in the machine tool sector based on their ability to provide, in a single compact unit, fluid at pressures which can reach 80 bar. Such pumps, understandably, have advantages over conventional centrifugal pumps for high-pressure applications.

In some applications, screw pumps, and three-screw pumps in particular, have been used as positive displacement pumps. Such screw pumps have low-pulsation and even delivery characteristics. They also have high wear resistance.

Due to their design, however, screw pumps (like other positive displacement pumps) require the use of a pressure regulating valve in order to keep delivery pressure constant. Such a pressure regulating valve may be provided in a system along with the associated machine tool. Screw pumps are operated with a constant rotational speed and, due to the positive displacement characteristics thereof, provide an approximately constant delivery. Since the machine tool being serviced by the pump often requires fluid delivery at a volume that is less than the flow volume provided by the pump, the excess delivery (referred to as differential delivery) is discharged through the pressure regulating valve. One result of this arrangement is that the efficiency of the system, as compared to the often high efficiency of the positive displacement pump, is reduced because a portion of the pump output necessary for the pressure build-up in the differential delivery is not used.

In the event of breaks in operation (e.g., when changing tools or the like), coolant lubricant is not pumped to the machine tool. To accommodate this, either a shut-off valve is installed in the supply line for the machine tool, or the pump is switched off. Due to the high mechanical load involved, switching off is usually only worth considering in the case of systems which operate at relatively low pressure. In systems with a shut-off valve, the pump continues to operate (i.e., with the shut-off valve closed) with the full pump discharge being accommodated by the pressure regulation valve. Such an arrangement understandably has a disadvantageous effect on system efficiency. In order to reduce the power requirement during breaks in operation, a controllable pressure regulating valve that can be depressurized during the breaks in operation, is often used.

The use of pressure regulating valves having variable pressure capabilities is known. Such valves have the advantage that the fluid supply can be adapted to the requirements of the process in a suitable manner. For example, in the case of tools having a low pressure requirement, the power consumption of the positive displacement pump falls with the pressure. Even so, for cases in which a valve is used, the power consumption of the pump is usually higher than the actual power requirement for the fluid supply to the tool, since a higher delivery is provided by the pump than is required by the tool. As coolant supply and cooling account for up to 35% of the energy consumption of a machine tool, the potential for improvement/optimization is considerable.

Using valves for pressure control includes additional disadvantages. For example, in systems used to supply coolant lubricant to machine tools, the switching of the valve(s) causes pressure pulsations which can heavily load the system and can even cause mechanical damage to system and tool components.

An alternative approach involves varying the rotational speed of the pump motor by means of a frequency converter. In such cases, system pressure downstream of the pump is monitored (e.g., using a pressure sensor) and is passed to a frequency converter as a closed-loop control variable. In this way the pump motor rotational speed is controlled as an open-loop control variable by means of a PI (proportional-integral) closed-loop control by means of the frequency converter.

Such a closed-loop control of this type—using a classic closed-loop control method—has the disadvantage, however, of insufficient dynamic response. In particular, it is not possible to obtain a rapid run up of the pump motor to its setpoint rotational speed, or to the setpoint pressure, without causing disadvantageous overshoot. By contrast, a more strongly damped rise leads to comparatively long run up and attendant response times, which, in turn, disadvantageously results in unproductive idle times of the associated machine tool or the like. In some applications, it has proven desirable to reach a setpoint value in no more than 500 milliseconds (ms) following switching on. Such a requirement, however, cannot be achieved in practice with known closed-loop control algorithms in the present context of the operational control of a screw pump.

Combinations of the previously described approaches have also been attempted. Thus, a closed-loop control of the pump motor using pump discharge pressure as open-loop control variable is combined with a downstream pressure regulating valve of the type previously described. Such approaches, however, require disadvantageously high outlays of equipment and/or result in poor dynamics.

An example of an operation control device for a positive displacement pump with a pump motor is disclosed in US Patent Application Publication No. 2002/0094910. Actuation means for rotational speed actuation for a pump motor are provided, along with state sensor means to detect a current operating parameter of the positive displacement pump in the form of an oil temperature. Operating mode means for predetermining an operating mode of the positive displacement pump are connected upstream of the actuation means.

SUMMARY

It is the object of the present invention to provide an operation control device for a positive displacement pump having a pump motor, which, after activation, achieves target values such as a setpoint pressure and/or a setpoint rotational speed, in as short a time as possible and without over- or undershoot effects. Such an arrangement avoids a high outlay in terms of equipment, particularly extra outlay due to shut-off and/or pressure regulating valves. It is a further object of the invention to create an operation control device which can be used flexibly, which is suitable for various setpoint operating parameter values (i.e. various setpoint pressures for tools which are to be used in a suitable manner), and which reduces power consumption in the interests of optimizing energy efficiency and avoiding disadvantageous pressure pulsations in the system.

The object is achieved by means of an operation control device, a pump system, and an operating method according to the appended claims.

In an advantageous embodiment according to the invention, operating mode means are provided for the actuation means (e.g., a frequency converter for the pump motor) in such a manner that the operating mode means can include a plurality of predetermined operating modes, other than a switched off state.

As compared to traditional closed-loop operation, which as previously noted suffers from the opposing disadvantages of overshoot in the case of fast run up and time delay in the case of slow run up, the inventive procedure employs first and second actuating modes. In the first actuating mode, and as a reaction to a detected operating parameter change, pump pressure (e.g., operating pressure) is increased within a predetermined time interval, adaptively and as a function of respective data and operating conditions, and with minimal rise time. When a first threshold operating parameter value (e.g., a pressure or rotational speed threshold value) is reached or exceeded, the system switches into the second actuating mode which, for approaching the setpoint operating parameter value (e.g., a setpoint pressure or setpoint rotational speed), enables a less steep operation, thus avoiding overshoot. Once the setpoint is reached, the value is regulated in an otherwise known manner in the second operating mode, even for stationary operation.

In one embodiment of the invention, the first threshold operating parameter value is determined as a predetermined fraction of the setpoint operating parameter value, or is calculated according to the invention. According to preferred embodiments of the invention, this fraction shifts between 90% and 98% of the setpoint value. In particularly preferred embodiments, this fraction is in the range between 94% and 96% of the setpoint value. Alternatively, a threshold value of a pump parameter derived from the setpoint operating parameter value can be calculated.

In this manner, dynamic pump operation, (i.e. pump operation having a short run-up or start-up time), can be achieved simply and elegantly, while meeting use conditions in the systems they serve. A non-limiting exemplary embodiment of such a system includes fluid supply for machine tools.

In a preferred embodiment, provision is made for the operating mode means to use a second threshold operating parameter value (e.g., a threshold pressure value) which is less than the first threshold operating parameter value, and which triggers detection according to the parameter change as a function of time. This aspect of the invention is based on the inventive finding that favorable detection conditions are present, not immediately after activation or switching on the pump, but rather only after reaching a threshold value (defined by the second threshold operating parameter value) which lies in a predetermined range in relation to the setpoint operating parameter value. According to preferred embodiments of the invention, this range is between approximately 15% and 25%, and in particular 20%, of the setpoint operating parameter value. In one embodiment, the second threshold operating parameter value is a pressure threshold value.

The invention may comprise deriving suitable parameters for the rising behaviour of the pump pressure during the first actuating mode as a reaction to a single detection of the change in operating parameter. In practice this may include determining an amplification factor for a PI control behavior of the actuating means, for instance, from the change in operating parameter during the first actuating mode. Alternatively, the invention may also include detecting the change in operating parameter per time interval (i.e., the operating parameter gradient in the time diagram) multiply and/or continuously during the first actuating mode, and thereupon adapting the control behavior during the first actuating mode.

It is also advantageous in additional embodiments to carry out a full-load starting operation until the second threshold operating parameter value is reached. Thus, the pump motor is started with maximum actuating output. This provides the advantage of minimizing the time involved in the early actuating phase without the risk of disadvantageous overshooting. In addition, there are defined conditions, for instance, for determining the parameter change at the end of the early starting phase to facilitate influencing further open-loop control during the first actuating mode.

It has proven favorable and practical in the context of the invention to reproduce the actuating behaviour in the first and in the second operating modes by means of a closed-loop control behavior (e.g., a PI control behavior), while at the same time providing a delimitation between the actuating modes, for instance by changing the closed-loop control amplification factor.

A preferred embodiment of the invention comprises considering the operating pressure (e.g., pump pressure) as an operating parameter and then carrying out open-loop control of the operation towards a setpoint pressure of the pump. This operating parameter may depend on the actual tool being serviced. With this setpoint pressure, both the first threshold value as the threshold pressure value and the second threshold value are present. The state sensor means may be a pressure sensor which detects operating pressure. In one embodiment, the pressure sensor continuously detects operating pressure for continuous feedback control.

Alternatively, it is contemplated within the context of the invention not to directly measure the operating pressure using a sensor. For such embodiments, operating pressure may be determined from other system and pump parameters in a known manner. Such system and pump parameters may be conventionally present and measurable in the context of the pump system. Examples of such parameters include motor voltage, the motor current, motor rotational speed, motor acceleration or other approximately constant pump parameters. Such parameters may be used in a known manner for determining operating pressure.

Preferred embodiments of the invention also comprise using other variables as alternatives to the operating pressure. For example, a current delivery of the positive displacement pump or a motor rotational speed of the pump motor may be used. It will be appreciated that the same variable (e.g. pressure) does not have to be detected for the setpoint operating parameter value and the at least one threshold value.

In one preferred embodiment, the operation control device portion of a pump system includes a positive displacement pump and a unit charged with fluid using the positive displacement pump. The positive displacement pump may be a screw pump, and may in some embodiments be a triple-screw pump. The unit can be a machine tool that is charged with cooling lubricant using the positive displacement pump at an operating pressure above 20 bar, more preferably above 40 bar, and most preferably above 60 bar.

In some embodiments it is desirable to operate the screw pump as a universal pump at high rotational speeds, thus enabling a comparatively small and inexpensive pump to be used. Accordingly, it is provided within the context of preferred embodiments of the invention for positive displacement pumps, in particular screw pumps, to be provided that can be operated at operating speeds above 3000 revolutions per minute (rpm), preferably above 4000 rpm, within the pump system.

A system according to the invention may achieve a setpoint operating parameter value, for instance a setpoint pressure, in less than 500 ms, which represents considerable progress over prior art systems and procedures. The system may obviate the need for pressure regulating valves, thus avoiding the need for additional mechanical and equipment outlay, and eliminating pulsations that occur due to valve switching operations as previously described.

As a result, the present invention makes it possible, in a surprisingly simple and elegant manner, to solve the problem associated with prior art systems and methods, including the prior art problems of dynamic operating behavior (i.e., the problem of rapidly reaching an setpoint operating parameter value without overshooting) without the need for additional mechanical outlay such as valves or the like. The present invention thereby provides a high level of flexibility and adaptability to different operating conditions, enabling it to be used with different machine tools having respectively different pressure conditions, without the need for complex adjustment, pre-configuration, or similar measures. As such, in addition to the optimized operation previously described, significant increases in efficiency can also be achieved in setup and conversion processes using the invention.

The invention is particularly well suited in the manner described for the field of high-pressure pumps used in fluid supply for machine tools in industrial environments. It will be appreciated, however, that it is not limited to this field of use. Rather, the present invention offers the described advantages in any technical field of use which requires adaptive, flexible, control behavior in pumps, and in particular in high-pressure ranges.

Further advantages, features and details of the invention result from the following description of preferred exemplary embodiments, and in the drawings.

DETAILED DESCRIPTION

Figure 1:
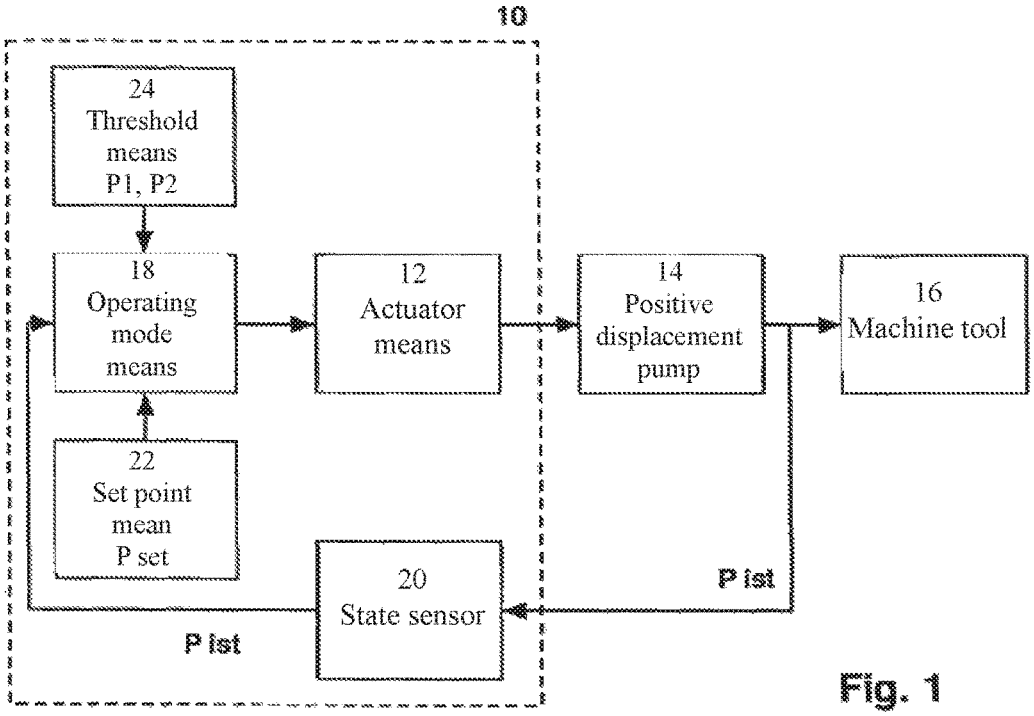
FIG. 1 is a schematic illustration of a pump system including an operation control device according to an exemplary embodiment of the invention.

FIG. 1 is a schematic block diagram of the operation control device according to a preferred embodiment of the invention, which comprises a pump system. In particular, FIG. 1 shows, as indicated by the dashed border line 10, an operation control device having actuating means 12, which in one embodiment is a frequency converter, for setting speed and for actuating a screw pump 14. The screw pump 14 is connected downstream from, and interacts with, a schematically shown machine tool 16. Such machine tools may include drilling or milling machines having changeable tool inserts and correspondingly changeable coolant delivery requirements. As arranged, the screw pump 14 may deliver coolant to the machine tool 16.

In the context of the preferred exemplary embodiment, operating mode means 18, in the form of a control unit, is connected upstream of the actuating means 12. The operating mode means 18 may be embodied in hardware or software components, and may take as input calculated and/or predefined threshold values 24 of an operating parameter (for example, pump pressure P) to actuate the actuating means 12. The operating mode means 18 may also take into account a respective unit-specific setpoint value 22 of the operating parameter, which in the illustrated embodiment is setpoint pressure (Pset). In the manner shown in FIG. 1, these influencing variables, namely at least one threshold value 24 and the setpoint value 22 (Pset), are provided to the operating mode means 18 in a suitable manner (as represented by functional unit blocks 22, 24). Alternatively, they may be calculated, as will be described in greater detail later.

Also illustrated is a state sensor unit 20, which in the exemplary embodiment is a pressure sensor, for detecting an actual pressure "Pact" on the output side of the screw pump 14 and providing it to the operating mode means 18 to utilize in further actuation operations.

The operation of the device according to FIG. 1 will now be described in relation to the pressure/time diagram of FIG. 2 and the flow chart of FIG. 3.

It is assumed by way of example that a screw pump of type EMTEC 20 R38 manufactured by the applicant Allweiler A G, Radolfzell, with a rating of 7.5 kW, interacts with a single-screw machine tool 16, which is configured as a drilling machine and is operated with three different drilling tools. Each of these three drilling tools requires a different delivery of coolant/lubricant fluid to be delivered by the pump 14, it being assumed that this delivery lies between 5 liters/minute (1/min) and 351/min. An assumed operating pressure at the pump output and unit input side is 80 bar in each case.

Figure 3:
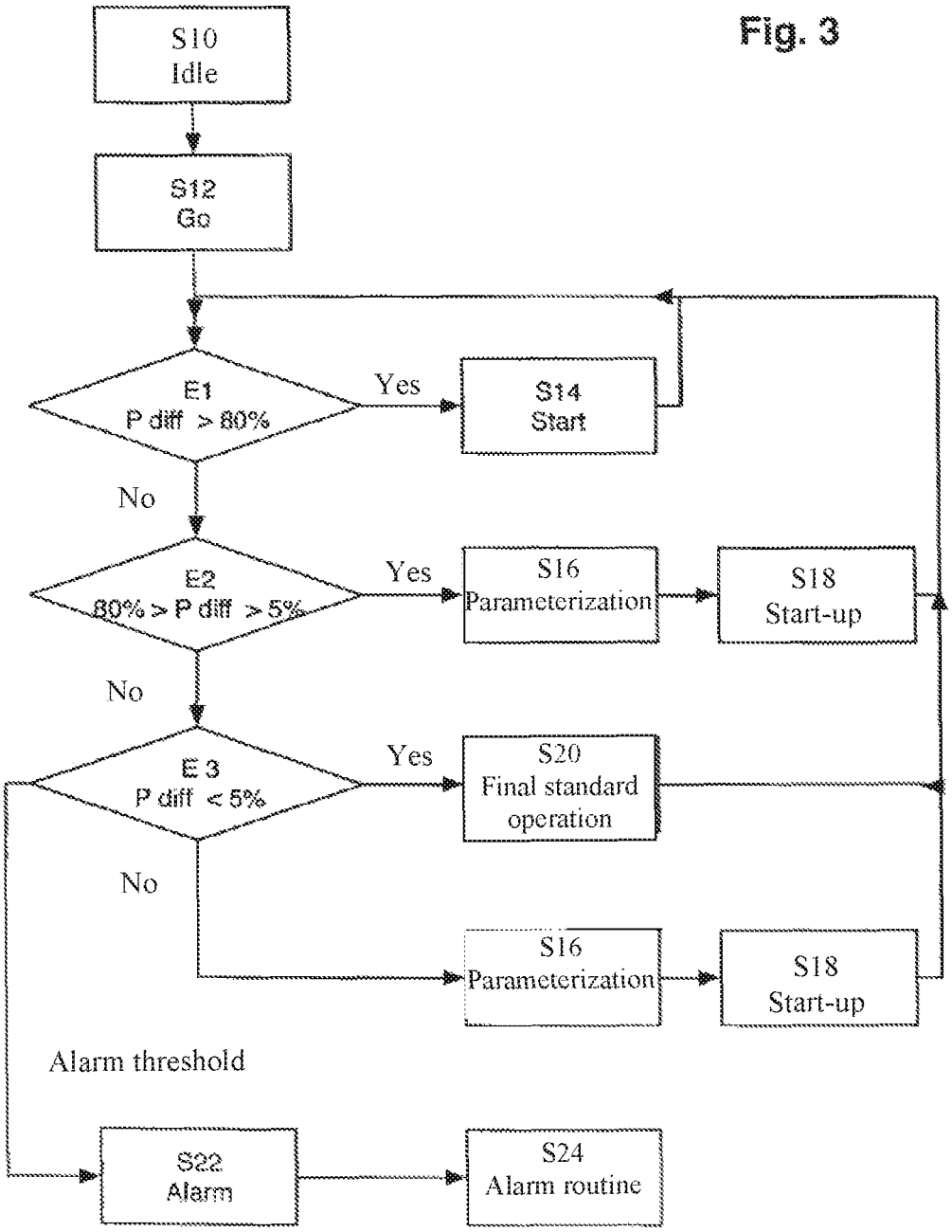
FIG. 3 is a flow chart illustrating an exemplary operating sequence according to the invention.

FIG. 3 illustrates, at step S10, an idle state before activating the arrangement. At step S12, initial start-up (Go) then follows by manual or automated actuation.

Figure 2:
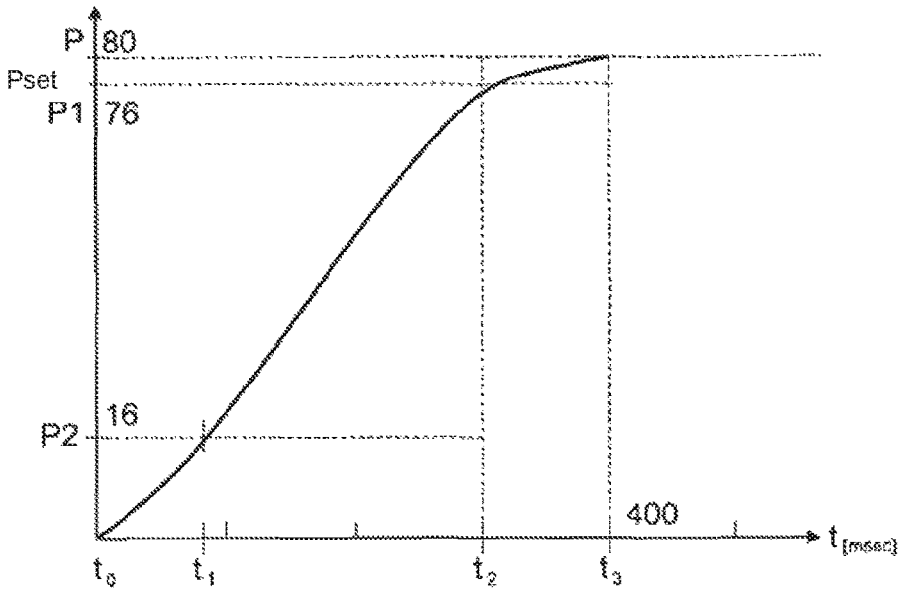
FIG. 2 is a pressure/time diagram illustrating exemplary operating behavior of the pump system of FIG. 1.

As a comparison of FIGS. 2 and 3 shows, the present invention allows the pump motor to be operated in a plurality of operating phases which are clearly separated or delimited from each other by suitable actuation or setting by the operating mode means 18. It is, therefore, initially provided according to the exemplary embodiment of FIGS. 1 to 3 for actuation of the screw pump to take place at maximum electrical actuating power by means of the frequency converter 12, after initial start-up (step S12) at time $t_0$. This results directly from the decision step E1 in FIG. 3, in which the differential pressure Pdiff (which is the difference between the setpoint pressure "Pset" and the detected actual pressure "Pact", in relation to the setpoint pressure, which in the described embodiment is 80 bar) is determined to be more than 80% below the setpoint operating parameter value (Pset). Quantitatively, this means the realization of a lower threshold value, in the exemplary embodiment at the 80% threshold (in relation to 80 bar Pset, that is P2=16 bar). Accordingly, the branch in FIG. 3 leads to the operating state of step S14 "Start," corresponding with an initial start-up mode, in this case at full electrical power.

As can be seen in FIG. 2, the pump actual pressure "Pact" (shown as the solid line) reaches the lower threshold P2 value at 16 bar at time $t_1$. In the illustrated embodiment, $t_1$ is about 80 msec. This ends the first mode of operation, at which point the operating mode means applies another actuating mode to the pump motor or the inverter connected upstream. The following then occurs, as shown in FIG. 3. When the lower threshold value P2 of 16 bar (corresponding to a pressure difference of less than 80% in relation to the setpoint pressure value) is exceeded, a branch is made to the right in decision step E2. According to the preferred embodiment, at step S16, a parametrization of a control mode in the second operating phase takes place between times $t_1$ and $t_2$ (see FIG. 2—corresponding to a pressure range of 16 bar as the lower threshold value and 76 bar as the upper threshold value, correspondingly 95% of Pset). A PI control operation is thus carried out, in which a pressure difference is initially determined per unit time interval by the operating mode means 18 after time $t_1$, as a gradient in the pressure curve (FIG. 2). Depending on this gradient, the system defines and specifies an amplification value and an integration time for the PI control behavior in the time region between $t_1$ and $t_2$. The system is then operated (at step S18) with this parameterization, as described by a PI control function. As can also be seen from the feedback of the loop shown in FIG. 3, a continuous parameterization (S16) takes place in the time range between $t_1$ and $t_2$. That is, repeated measurements are made of a current increase in the pressure curve, and thereupon P and I values of the closed-loop control are set. In the exemplary embodiment of FIG. 2, the curve profile shown with a parameterization (S16) after time $t_1$ would lead to a typical amplification V=8 with an integration time I=5 msec (for instance, compared to the maximum actuation in the phase $t_0$ to $t_1$, where actuation took place with an amplification V=1 and an integration time I=2 msec).

The pressure rise over time then takes place in the manner shown in FIG. 2 until an upper threshold value P1 at 76 bar is reached. In one embodiment, this threshold value is 95% of Pset. This threshold value is reached at time $t_2$, in the illustrated embodiment, at approximately 300 msec after $t_0$. At this time, the operating open-loop and closed-loop control behavior of the operating mode means 18 also changes, whereby, in accordance with decision step E3 (FIG. 3), the system executes a final closed-loop operation. In one embodiment, this is a closed-loop operation which has a reduced amplification and/or extended integration time for the PI parametrisation compared to closed-loop operation in the preceding operating phase. In other words, as can be seen starting from the upper threshold value P1, the operation shows a markedly flatter rising behavior in the direction towards the setpoint value Pset. Advantageously, this leads to a slowed approach to the setpoint value Pset (at 80 bar), which takes place in the time interval between $t_2$ and $t_3$ reducing or eliminating the chance for disadvantageous overshoot. Thus, this final closed-loop control operation, carried out at step S20, constitutes an operating state in which the setpoint value can be reached in an optimised time from $t_2$. Stationary pump operation is then carried out in further stationary operation, even with these stationary pump operation closed-loop control parameters (typically amplification V=3, integration time I=10 msec).

In the event that an unexpected loading of the system occurs, for example, due to the switching off or failure of the connected machine tool, operating states can occur in which pump pressure exceeds the setpoint value. In principle, it would be possible by means of the final closed-loop control operation (step S20) to compensate for this (upwards) deviation. This may, however, require an undesirably long time. Accordingly, as shown in FIG. 3, following the decision step E3 in which the pressure setpoint value is exceeded by more than 5% (i.e. actual pressure>105% of P), the system turns to the steep parameterization operation from step S16 or S18 (i.e., in accordance with the steep behaviour between the time sections $t_1$ and $t_2$). As soon as the tolerance threshold (here: 5%) for the final closed-loop control operation (step S20) is reached, operation continues accordingly.

The flow chart of FIG. 3 additionally shows the introduction of an alarm routine (step S22 or S24) if a predetermined alarm condition is detected at decision E3. The alarm condition can be a predetermined pressure condition, but it can also be based on other input variables, such as exceeding a critical temperature.

Figure 4:
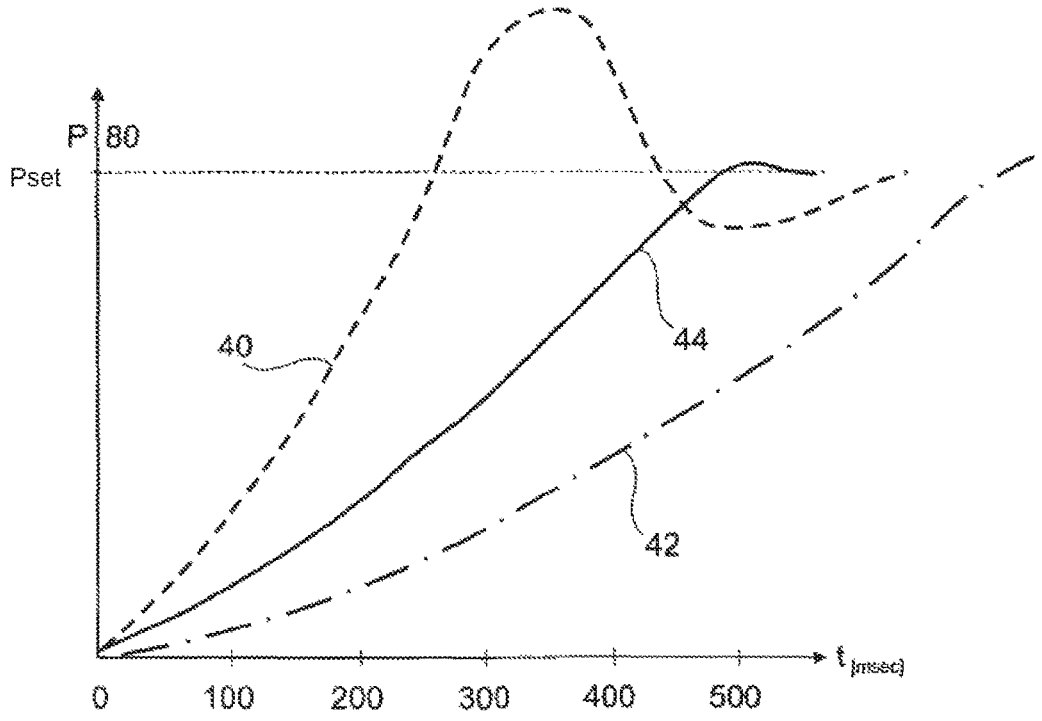
FIG. 4 is a pressure/time diagram analogous to FIG. 2, illustrating exemplary operating behaviour of conventional devices having varied operating requirements, such as delivery requirements, for different tools serviced by the pump system of FIG. 1.

Various actuating modes and operating phases of the pump motor, generated in the run-up and start-up state, are shown in the curve profiles of FIG. 4. FIG. 4 shows the operating behavior of an operation control device having the same pump configuration, and which in one example is a PI controller, for use with various tools and various system loads connected therewith. Curve 40, for example, relates to a first drilling tool, in which a low required delivery (5 l/min) leads to a marked overshooting of the system. Curve 42, relates to a large tool having a comparatively high delivery requirement (delivery rate 35 l/min) which brings about a very long initial period and clearly exceeds the required 500 msec limit. Only the middle tool, represented by curve 44, and having a delivery rate of 15 l/min, approximately achieves the curve profile of FIG. 2. As can be seen, curve 44 illustrates only slight overshoot when reaching Pset, thus approximating the short curve profile of FIG. 2. Such operation is obtained independently of the respective delivery requirement, and is adaptively set for all required tools, namely by means of appropriate adaptive parametrisation in the range of operating phases below the upper threshold value, and particularly in the middle rise region (i.e., step S18 between $t_1$ and $t_2$).

It will be appreciated that the present invention is not limited to the provision of two threshold values P2, P1, which, in the exemplary embodiment are 20% and 95% of the setpoint value, respectively. Rather, one or both of these threshold values can be set at different values from those explicitly described in relation to the preferred embodiments. In addition, it is contemplated that only a single threshold value may be used. In one embodiment, the single threshold value may be the upper threshold value P1. Alternatively, any desired number of threshold values may be used, as long as such values are appropriately described in a consistent functional context. In addition, setting or adapting the operation of the system can be in accordance with a single or repeated gradient measurement on the pressure profile. This may be done in relation to at least the upper threshold value.

It is also contemplated that operating parameters other than pressure may be used in the inventive system and method. For example, the operating parameter may be the rotational speed of the pump motor, with analogous upper and, if appropriate, lower threshold values set, determined or ascertained in some manner as respective fractions.

As a result, the present invention makes it possible in a surprisingly effective manner to obtain fast and dynamic run-up behaviour of a screw pump, while at the same time minimizing the required outlay in terms of equipment and hardware. According to one preferred embodiment, the system of FIG. 1 operates without a pressure regulating valve, and thus, operation of the system occurs in an energy efficient manner.

What is claimed is:

1. A system for operating a positive displacement pump having a pump motor, the system comprising:

a control unit for receiving threshold values of an operating parameter; and a frequency converter connected between the control unit and the pump, the frequency converter for receiving the operating parameter for actuating the pump;

wherein the control unit is configured to control operating the pump motor in a first actuating mode when the operating parameter of the positive displacement pump is between a lower threshold value (P2) and an upper threshold value (P1), wherein the lower threshold value (P2) is in range of 15%-25% of a target operating parameter value (Pset), and wherein the upper threshold value is in a range of 90%-98% of the target operating parameter value (Pset), the first actuating mode providing a pump pressure that constantly increases toward the target operating parameter value (Pset) and that, in its rising behavior in relation to pump pressure, is dependent on a detected change in the operating parameter over a predetermined time interval; and wherein the control unit is configured to control operating the pump motor in a second actuating mode that is different from the first actuating mode when the operating parameter is above the upper threshold value (P1) for more controlled operation toward the target operating parameter value (Pset) relative to the first actuating mode.

2. The system according to claim 1, wherein a change in the operating parameter is detected more than once, and in each case influences the respective first actuating mode.

3. The system according to claim 1, wherein the pump motor is operated at a maximum actuation power when the operating parameter is below the lower threshold value (P2).

4. The system according to claim 1, wherein a control amplification associated with operating the pump motor is greater in the first actuating mode than in the second actuating mode, and wherein the controlled operation comprises a PI control behavior.

5. The system according to claim 1, wherein the operating parameter is an actual operating pressure (Pact) of the positive displacement pump.

6. The system according to claim 1, wherein the operating parameter is derived from at least one parameter selected from a list consisting of a motor voltage, a motor current, a motor rotational speed, a rotational acceleration, and a pump constant of the positive displacement pump.

7. The system according to claim 1, wherein the operating parameter is a current delivery of the positive displacement pump.

8. The system according to claim 1, wherein a prespecified violation of the target operating parameter value (Pset) is detected and, in response to such violation sets an actuating mode, the pump motor is operated in an actuating mode that is different from the second actuating mode.

9. The system according to claim 1, wherein at least one of a cooling fluid and a lubricating fluid is supplied to a machine tool using the positive displacement pump.

* * * * *